US007837426B2

(12) United States Patent
Lesko

(10) Patent No.: US 7,837,426 B2
(45) Date of Patent: Nov. 23, 2010

(54) TEETER BEAM ASSEMBLY

(76) Inventor: Gerald Lesko, 4807-68 Avenue, Edmonton, AB (CA) T6B 2N2

( * ) Notice: Subject to any disclaimer, the term of this patent is extended or adjusted under 35 U.S.C. 154(b) by 372 days.

(21) Appl. No.: 11/956,851

(22) Filed: Dec. 14, 2007

(65) Prior Publication Data

US 2009/0056932 A1 Mar. 5, 2009

(30) Foreign Application Priority Data

Aug. 31, 2007 (CA) ..... 2599911

(51) Int. Cl.
*B66C 23/00* (2006.01)

(52) U.S. Cl. ..... 414/746.4; 414/22.62; 414/746.2; 194/40

(58) Field of Classification Search ..... 108/7, 108/8; 14/71.3, 71.7; 193/16–17, 22, 35 R, 193/36, 38; 198/311, 360, 369.2, 569, 589, 198/750.14, 750.5, 750.7, 774.1, 774.2, 861.5; 211/70.4; 254/88; 414/22.51, 22.54, 22.55, 414/22.57, 22.58, 22.59, 22.61, 22.62, 276, 414/470, 745.1, 745.2, 745.4–745.9, 746.1–746.2, 414/746.4, 746.6, 525.9, 529, 531–534, 537
See application file for complete search history.

(56) References Cited

U.S. PATENT DOCUMENTS

| | | | | |
|---|---|---|---|---|
| 3,666,081 | A * | 5/1972 | Axenfeld | 198/311 |
| 3,858,731 | A * | 1/1975 | Briggs | 29/781 |
| 4,051,956 | A * | 10/1977 | Teague | 414/746.4 |
| 4,067,453 | A * | 1/1978 | Moller | 414/22.61 |
| 6,311,788 | B1 * | 11/2001 | Weixler | 175/52 |
| 2006/0045655 | A1 * | 3/2006 | Wells | 414/22.61 |

* cited by examiner

*Primary Examiner*—Gregory W Adams
(74) *Attorney, Agent, or Firm*—Dennis T. Griggs; Scott T. Griggs; Griggs Bergen LLP

(57) ABSTRACT

A teeter beam assembly is provided for attachment to a pipe launcher that can be tilted towards or away from the pipe launcher to move joints of drilling pipe on to or off of the pipe launcher by rolling pipes with the assistance of gravity. The teeter beams assembly can consist of a frame, a pair of vertical guide assemblies on each of the outer and inner ends of the frame, a longitudinal beam glidably coupled to the guide assemblies and a pair of rams coupling the beam to the frame for raising and lowering either end of the beam with respect to the frame.

5 Claims, 6 Drawing Sheets

TEETER BEAM ASSEMBLY

BACKGROUND OF THE INVENTION (1) Field of the Invention

The present disclosure relates to the field of assemblies for loading joints of drilling pipe onto and off of a pipe launcher used on a drilling rig, specifically, teeter beam assemblies that tilt towards and away from pipe launchers to move joints of pipe with the assistance of gravity.

(2) Description of the Related Art

Drilling pipe, as used on drilling rigs, is usually stored horizontally on pipe racks located on the ground near the drilling rig. On rigs using a pipe launcher to present joints of pipe to an elevated drilling platform, the pipe racks are positioned beside the pipe launcher to provide pipe to the pipe launcher when a well is being drilled and/or to receive pipe that is being tripped out of the drill string.

It is, therefore, desirable for reasons of safety and efficiency to provide a pipe teeter beam assembly attached to a pipe launcher that can tilt to move joints of pipe towards or away from the pipe launcher.

BRIEF SUMMARY OF THE INVENTION

A teeter beam assembly is provided that is adapted to be attached to a pipe launcher that moves joints of drilling pipe towards or away from the pipe launcher with the assistance of gravity.

In a representative embodiment, the teeter beam assembly can be operatively attached to a side of a pipe launcher and can extend substantially perpendicular from the pipe launcher. In one embodiment, at least two assemblies can be provided to balance a joint of pipe that is being loaded onto or off of the piper launcher. Three or more such teeter beam assemblies can be used for longer lengths of pipe, the number of which can easily be determined by one skilled in the art having regard to the size and length of the pipe.

In another embodiment, the teeter beam assembly can comprise a lattice-type frame having inner and outer ends. The inner end can be adapted to operatively attach to a pipe launcher. In some embodiments, the inner end can be hingeably coupled to the pipe launcher to allow the teeter beam assembly to be folded against the side of the pipe launcher when it is being transported or stored when not in use. The outer end can comprise a support leg that can be adjustable in length to support the teeter beam assembly off the ground.

The teeter beam assembly can further comprise guide assemblies at each of the inner and outer ends, the guide assemblies disposed on top of the frame. A longitudinal beam can be disposed on top of the frame between the guide assemblies. Each end of the beam can be operatively coupled to a guide assembly whereby each end of the beam is capable of vertical movement while coupled to the guide assemblies. In a representative embodiment, the guide assemblies can comprise vertical slotted members that are adapted to receive a vertical plate member located at each end of the beam. This configuration can allow each end of the beam to move vertically within the guide assemblies.

In another embodiment, the frame can comprise of horizontal top and bottom rails. The top rail can further comprise vertical openings adapted to allow the rams to pass through. In this embodiment, the rams can be attached at their lower ends to the bottom rail whereas the upper ends of the rams can pass through the openings in the top rail to attach to the beam. When the outer ram is extended, the beam can be raised or elevated at the outer end thereby tilting the beam towards the pipe launcher. In this position, joints of pipe on the teeter beam assembly will roll towards to the pipe launcher with the assistance of gravity. When the inner ram is extended, the beam can be raised or elevated at the inner end thereby tilting the beam away from the pipe launcher. In this position, joints of pipe on the teeter beam assembly will roll away from the pipe launcher with the assistance of gravity.

Broadly stated, a teeter beam assembly for a pipe launcher is provided that can comprise a frame having a top rail and a bottom rail, the frame further comprising outer and inner ends, the inner end adapted to operatively attach to the pipe launcher, the outer end comprising a support leg adapted to support the frame above a ground surface when the frame is operatively attached to the pipe launcher; a pair of vertical guide assemblies disposed on top of the top rail, one guide assembly disposed near each of the outer and inner ends of the frame; a longitudinal beam having outer and inner ends, the beam operatively disposed above the top rail and between the vertical guide assemblies, each end of the beam comprising a guide member glideably coupled to one of the vertical guide assemblies; and a pair of rams operatively coupling the beam to the frame, one of the pair of rams disposed nearer the outer end, the other of the pair of rams disposed near the inner end whereby the outer end of the beam is elevated when the outer ram is extended further than the inner ram, and whereby the inner end of the beam is elevated when the inner ram is extended further than the outer ram.

DETAILED DESCRIPTION OF THE INVENTION

Figure 1:
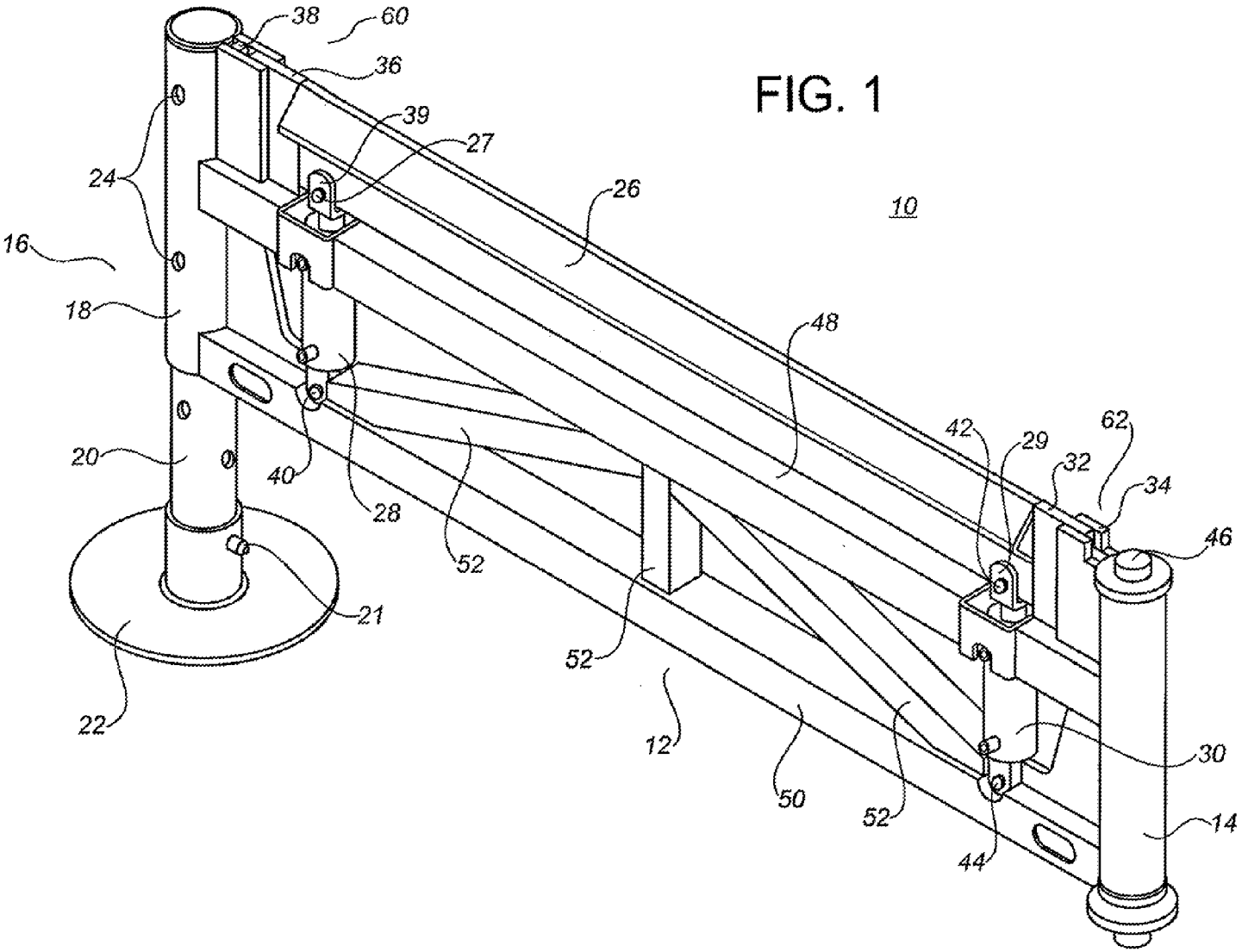
FIG. 1 is a front perspective view depicting a teeter beam assembly.
Figure 2:
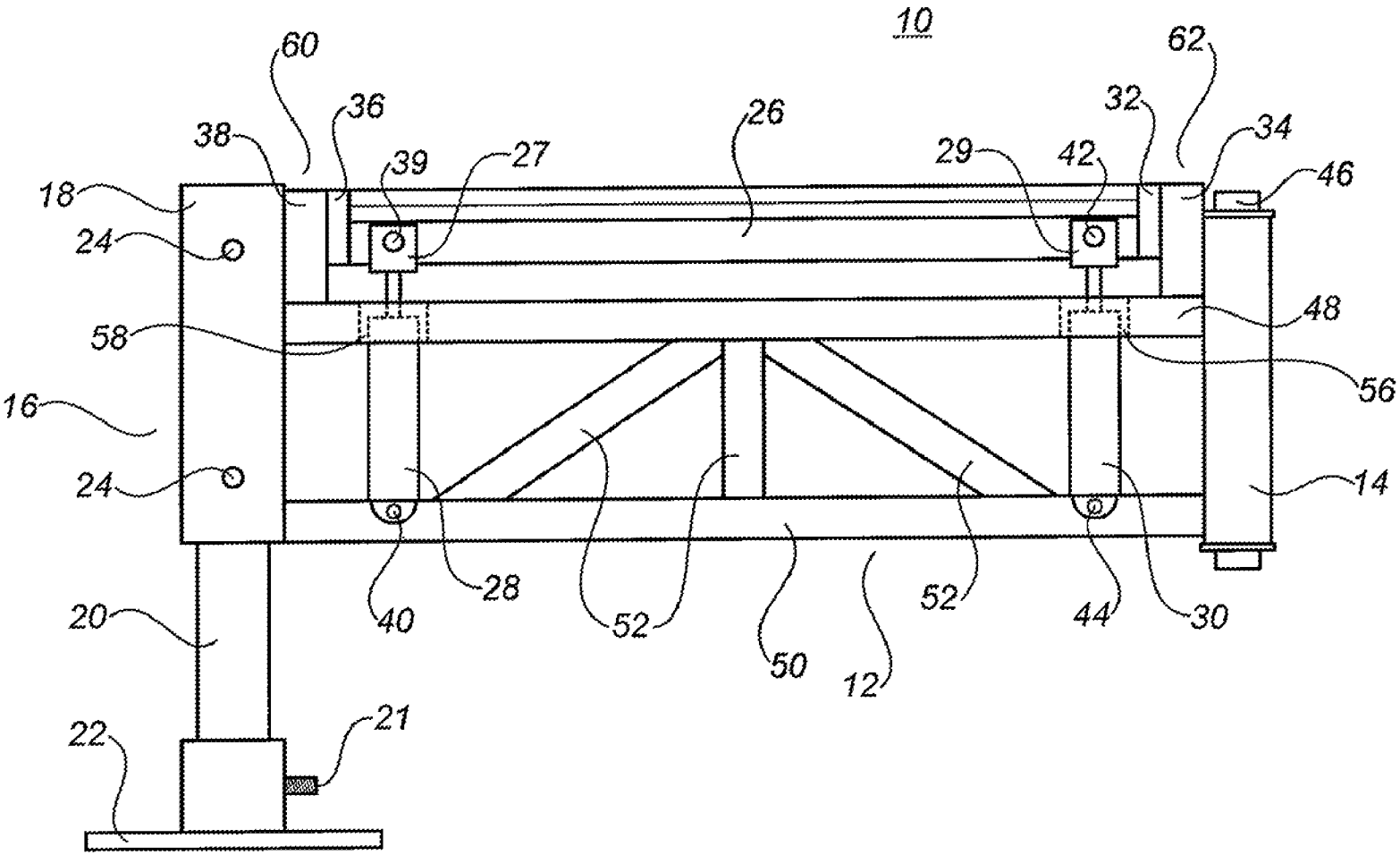
FIG. 2 is a front elevational view depicting the teeter beam of FIG. 1 in a horizontal position.

Referring to FIGS. 1 and 2, an embodiment of teeter beam assembly 10 is shown. Assembly 10 can comprise of frame 12, leg assembly 16, hinge assembly 14, guide assemblies 60 and 62, beam 26 and rams 28 and 30.

In this embodiment, frame 12 can comprise top rail 48 and bottom rail 50 disposed horizontally between leg assembly 16 and hinge assembly 14. Brace members 52 disposed between top and bottom rails 48 and 50 can provide strength to frame 12. Leg assembly 16 can comprise of leg sleeve 18, inner leg 20 and base 22. Inner leg 20 can be fitted within leg sleeve 18 and be secured by bolts 24. Base 22 can be secured to inner leg 20 by setscrew 21. Guide assemblies 60 and 62 can be disposed on top of top rail 48 at both of outer and inner ends of frame, respectively. Beam 26 can be disposed on top of top rail 48 between guide assemblies 60 and 62. Guide assembly 60 can comprise outer guide slot 38 that can receive outer guide plate 36 on beam 26. Guide assembly 62 can comprise inner guide slot 34 that can receive inner guide plate 32 on beam 26.

In one embodiment, outer ram 28 can be attached at its lower end to bottom rail 50 near leg assembly 16 and can be secured by bolt 40. The upper end of ram 28 can pass through opening 58 in top rail 48 and can comprise U-shaped bracket 27 that can be coupled to beam 26 via bolt 39. Inner ram 30 can be attached at its lower end to bottom rail 50 near hinge assembly 14 and can be secured by bolt 44. The upper end of ram 30 can pass through opening 56 in top rail 48 and can comprise U-shaped bracket 29 that is coupled to beam 26 via bolt 42. In this and other embodiments, rams 28 and 30 can be pneumatically or hydraulically operated as well known to those skilled in the art.

In another embodiment, assembly 10 can attach to a pipe launcher (not shown) via hinge 14 and bolt 46. This configuration can allow assembly 10 to fold against the side of the pipe launcher when being transported or stored when not in use.

Figure 3:
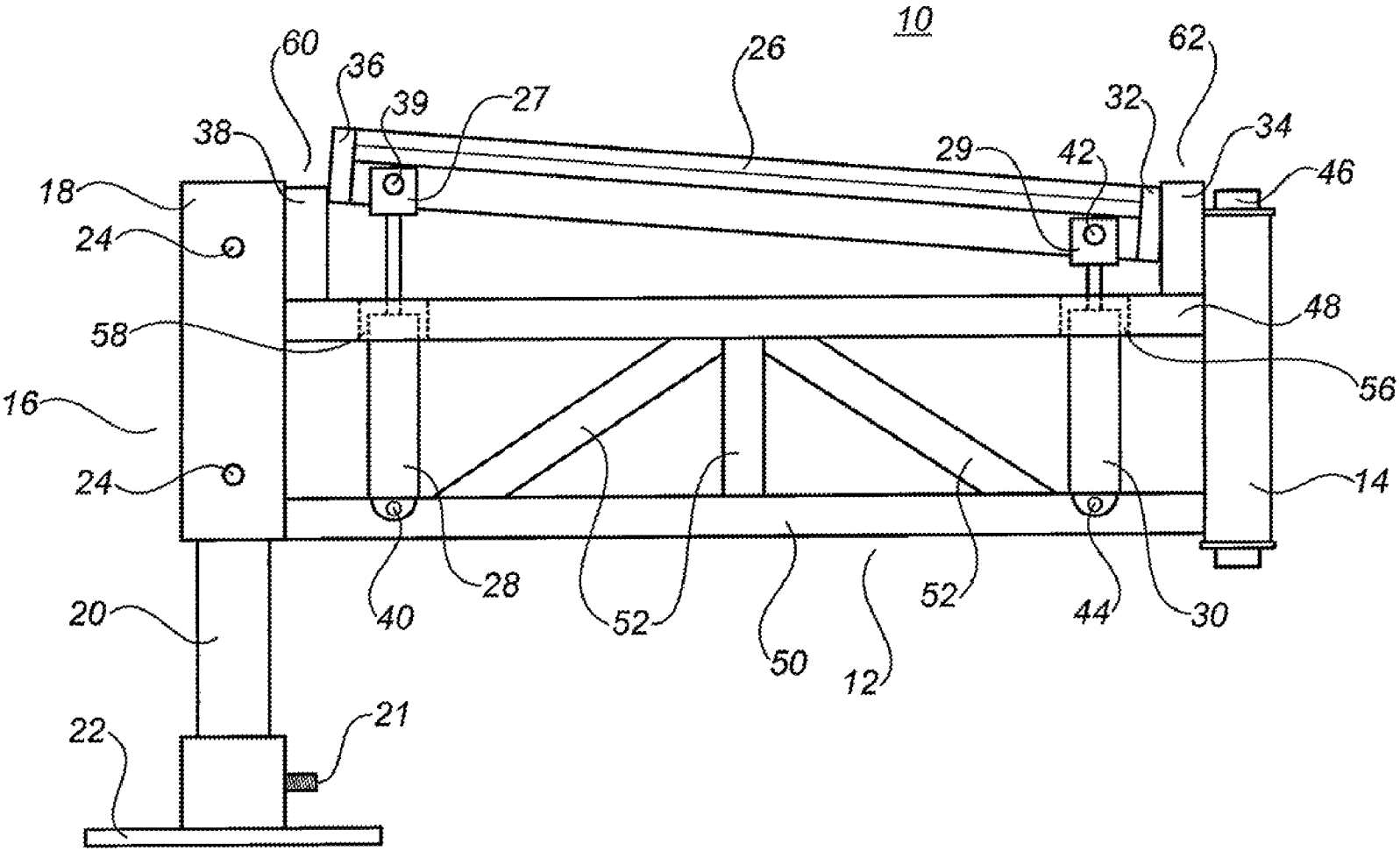
FIG. 3 is a front elevational view depicting the teeter beam of FIG. 1 with its outer end in an elevated position.
Figure 4:
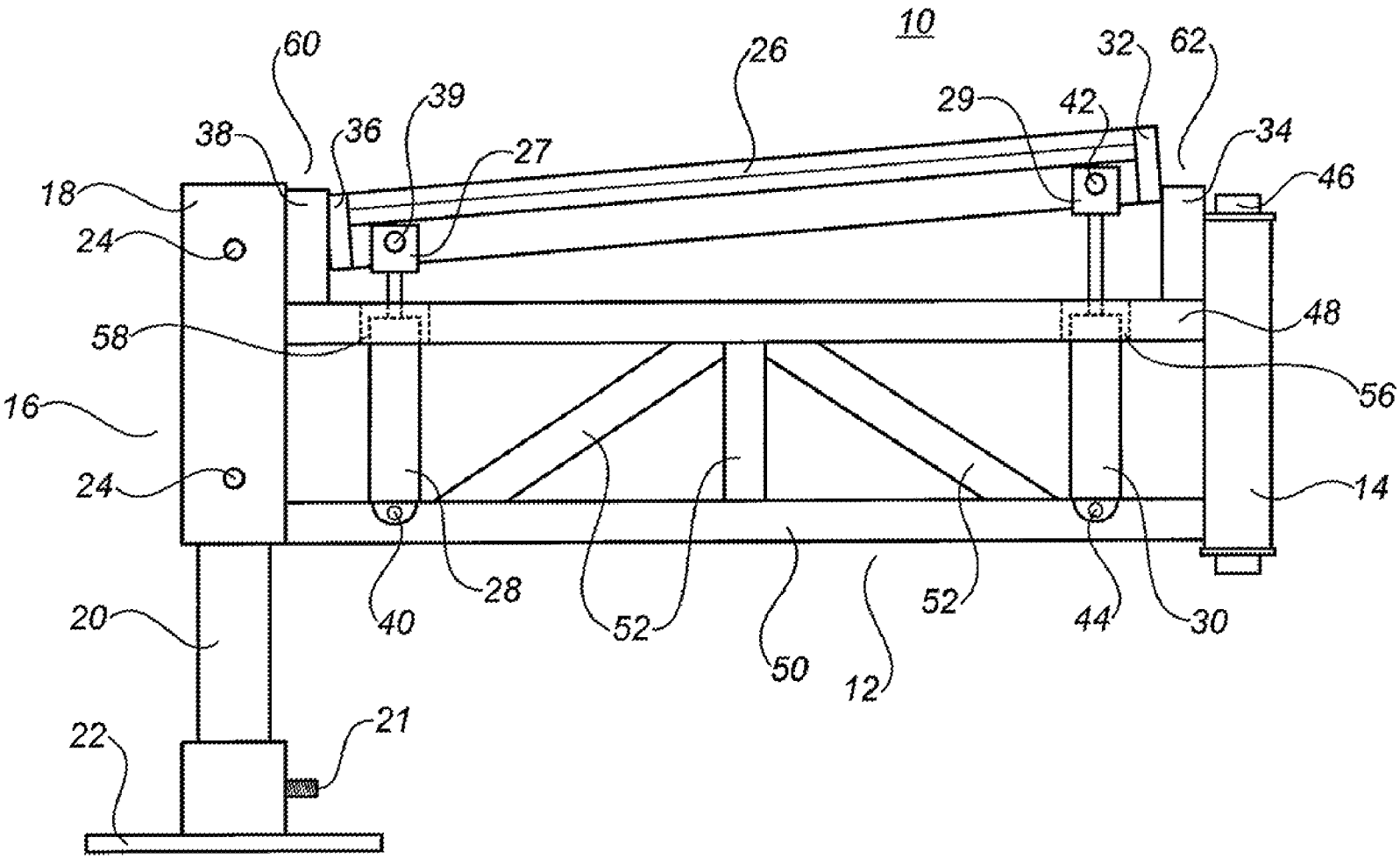
FIG. 4 is a front elevational view depicting the teeter beam of FIG. 1 with its inner end in an elevated position.

Referring to FIG. 3, assembly 10 is shown with ram 28 extended to elevate outer guide plate 36 vertically upwards within guide slot 38. This tilts beam 26 towards to a pipe launcher (not shown). Referring to FIG. 4, assembly 10 is shown with ram 30 extended to elevate inner guide plate 32 vertically upwards within inner guide slot 34 thereby tilting beam 26 away from a pipe launcher.

Figure 5:
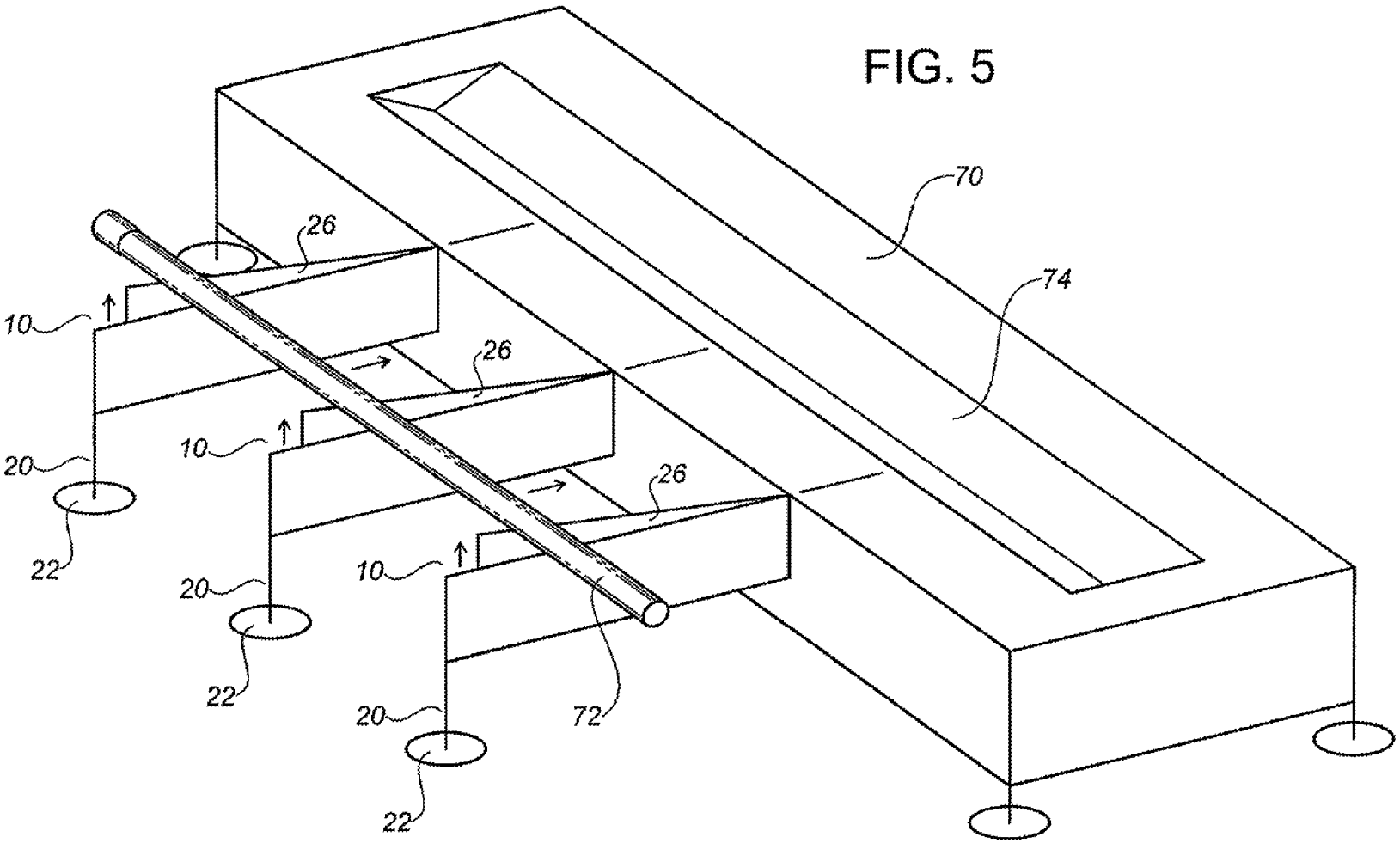
FIG. 5 is a front perspective view depicting the teeter beam of FIG. 1 loading a joint of pipe onto a pipe launcher.
Figure 6:
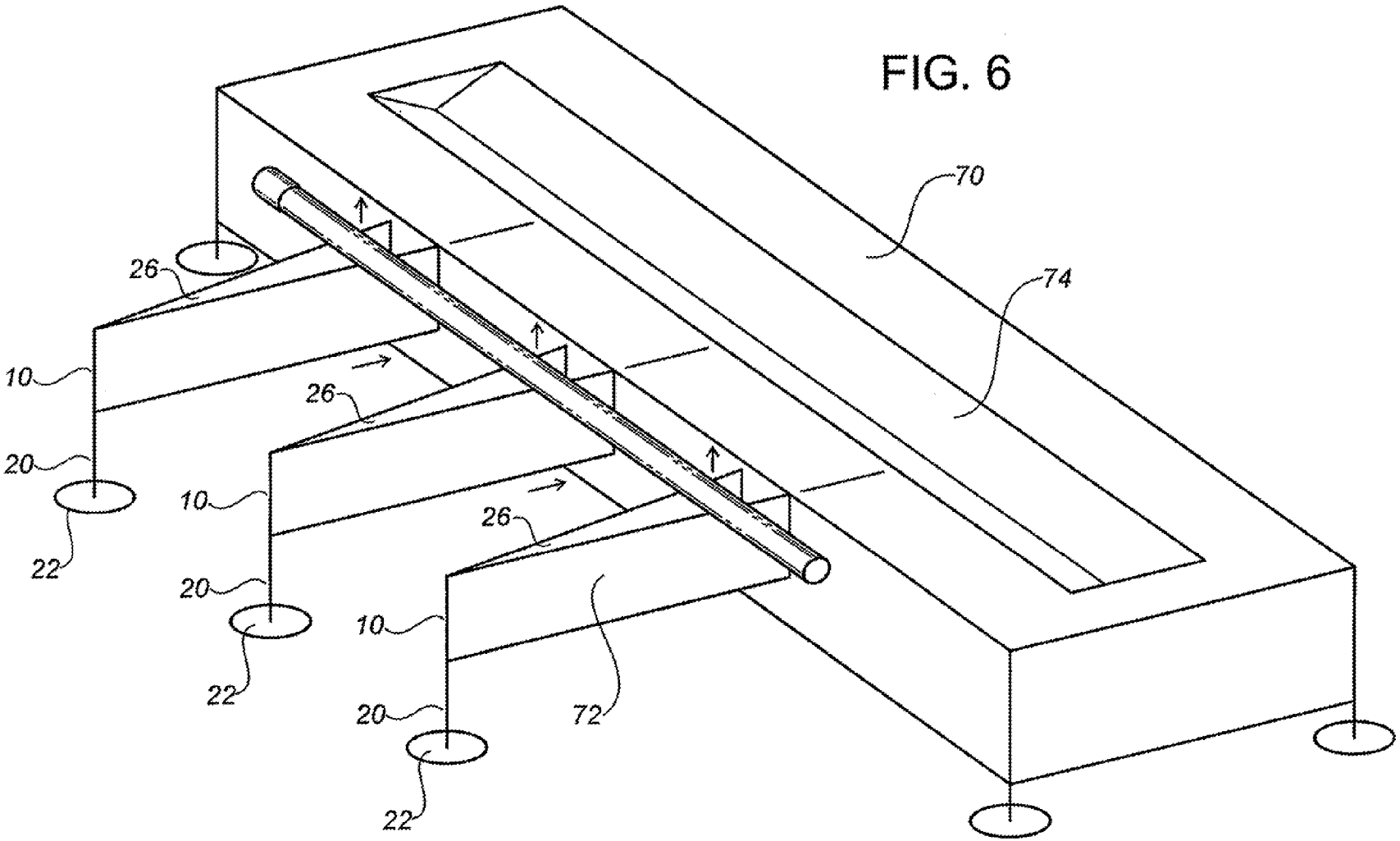
FIG. 6 is a front perspective view depicting the teeter beam of FIG. 1 loading a joint of pipe off of a pipe launcher.

Referring to FIG. 5, a plurality of teeter beam assemblies 10 are shown operatively attached to pipe launcher 70. When pipe 72 is to be loaded onto pipe launcher 70, beams 26 of assemblies 10 can be tilted towards pipe launcher 70. In this position, pipe 72 can roll down beams 26 with the assistance of gravity towards pipe launcher 70 to be loaded into pipe trough 74. When pipe 72 is being loaded off of pipe launcher 70, as shown in FIG. 6, beams 26 on assemblies 10 can be tilted away from pipe launcher 70 so that pipe 72 can roll down beams 26 with the assistance of gravity away from pipe launcher 70 to be stored away on a pipe rack (not shown).

Although a few preferred embodiments have been shown and described, it will be appreciated by those skilled in the art that various changes and modifications might be made without departing from the scope of the invention. The terms and expressions used in the preceding specification have been used herein as terms of description and not of limitation, and there is no intention in the use of such terms and expressions of excluding equivalents of the features shown and described or portions thereof, it being recognized that the scope of the invention is defined and limited only by the claims that follow.

I claim:

1. A teeter beam assembly for a pipe launcher, comprising:

a) a frame having a top rail and a bottom rail, the frame further comprising outer and inner ends, the inner end adapted to operatively attach to the pipe launcher, the outer end comprising a support leg adapted to support the frame above a ground surface when the frame is operatively attached to the pipe launcher;

b) a pair of vertical guide assemblies disposed on top of the top rail, one guide assembly disposed near each of the outer and inner ends of the frame;

c) a longitudinal beam having outer and inner ends, the beam operatively disposed above the top rail and between the vertical guide assemblies, each end of the beam comprising a guide member glideably coupled to one of the vertical guide assemblies; and d) a pair of rams operatively coupling the beam to the frame wherein the rams are disposed within the frame, each of the rams passing through an opening disposed in the top rail and operatively coupled to the bottom rail, one of the pair of rams disposed nearer the outer end, the other of the pair of rams disposed near the inner end wherein the outer end of the beam is elevated when the outer ram is extended further than the inner ram, and wherein the inner end of the beam is elevated when the inner ram is extended further than the outer ram.

2. The teeter beam assembly as set forth in claim 1 wherein each of the vertical guide assemblies further comprises a vertical slotted member, and wherein each end of the beam comprises a vertical plate member adapted to glideably couple with one of the vertical slotted members.

3. The teeter beam assembly as set forth in claim 1 wherein the rams are hydraulically or pneumatically operated.

4. The teeter beam assembly as set forth in any one of claims 1, 2 or 3 further comprising the pipe launcher, the teeter beam assembly operatively attached to the pipe launcher.

5. The teeter beam assembly as set forth in claim 4 wherein the inner end of the frame is hingeably coupled to the pipe launcher wherein the frame can swing from a first position wherein the frame is adjacent to the pipe launcher to a second position wherein the frame is substantially perpendicular to the pipe launcher.

* * * * *